US006863541B2

(12) United States Patent
Kagami

(10) Patent No.: US 6,863,541 B2
(45) Date of Patent: Mar. 8, 2005

(54) SEMICONDUCTOR SOCKET AND METHOD OF REPLACEMENT OF ITS PROBES

(75) Inventor: Sumio Kagami, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 10/421,827

(22) Filed: Apr. 24, 2003

(65) Prior Publication Data

US 2003/0224650 A1 Dec. 4, 2003

(30) Foreign Application Priority Data

May 31, 2002 (JP) ..... 2002-158601

(51) Int. Cl.[7] ..... H01R 12/00
(52) U.S. Cl. ..... 439/71
(58) Field of Search ..... 439/70, 71, 66; 324/761

(56) References Cited

U.S. PATENT DOCUMENTS 5,215,472 A * 6/1993 DelPrete et al. ..... 439/71
5,247,250 A * 9/1993 Rios ..... 324/754
5,362,241 A * 11/1994 Matsuoka et al. ..... 439/66
5,410,260 A * 4/1995 Kazama ..... 324/758
5,688,127 A * 11/1997 Staab et al. ..... 439/66
5,727,954 A * 3/1998 Kato et al. ..... 439/66
5,865,639 A * 2/1999 Fuchigami et al. ..... 439/330
5,877,554 A * 3/1999 Murphy ..... 257/727
6,322,384 B1 * 11/2001 Ikeya ..... 439/331

FOREIGN PATENT DOCUMENTS

| | | |
|---|---|---|
| JP | 62-58779 | 4/1987 |
| JP | 08-213088 | 8/1996 |
| JP | 09-033568 | 2/1997 |
| JP | 2001-116795 | 4/2001 |

* cited by examiner

*Primary Examiner*—Neil Abrams
(74) *Attorney, Agent, or Firm*—Rabin & Berdo, P.C.

(57) ABSTRACT

A semiconductor socket is provided which includes a stage used for positioning of a semiconductor device. The semiconductor device has a plurality of external input/output terminals mounted at a bottom thereof. The semiconductor socket also has a plurality of probes used to come into contact with the plurality of external input/output terminals when the semiconductor device has been positioned, by moving the stage towards the probes. The semiconductor socket has a socket base in which a major portion of each of the probes is housed, and from which a minor portion of each of the probes projects from an upper face thereof. The upper face of the socket base faces the stage. The probes are disposed in a manner so as to be inserted in or pulled out from the upper face. The semiconductor socket has a probe retaining cap removably mounted to the upper face of the socket base, for preventing the probes from being removed. A method of replacing the probes is also proposed.

4 Claims, 7 Drawing Sheets

SEMICONDUCTOR SOCKET AND METHOD OF REPLACEMENT OF ITS PROBES

BACKGROUND OF THE INVENTION

1. Field of the Invention

The present invention relates to a semiconductor socket at a bottom of which external input and output terminals are area-arranged in a grid form such as a BGA (Ball Grid Array) used to have the semiconductor socket come into contact with probes in order to make electrical test on the semiconductor device.

2. Description of the Related Art

The semiconductor device made up of a package being called a BGA has solder balls serving as its external input and output terminals arranged at a bottom of the semiconductor device in a grid form.

In order to secure electrical characteristics of the semiconductor device as described above, a semiconductor test apparatus is used. The semiconductor test apparatus, as shown in FIG. 7, is so configured that a conventional semiconductor socket 50 is mounted in a predetermined position on a socket mounting substrate 61 constituting a socket holder 60 and in the conventional semiconductor socket 50 is housed the above semiconductor device by using a handling machine (not shown).

FIG. 4 shows the above conventional semiconductor socket 50. The conventional semiconductor socket 50 shown in FIG. 4 is provided with a stage 51 used to perform positioning on a semiconductor device at a bottom of which a plurality of solder balls is mounted, probes 53 each coming in contact with each of the solder balls placed in the semiconductor device on which positioning has been performed by approaching of the stage 51 acting against elasticity of a spring 52, a socket base 54 to house the probes 53 in an extruded state in a manner to face the socket base 54, a rear cap 55 being fixed at a bottom of the socket base 54 to prevent each of the probes 53 from coming off in a downward direction, a rear cap fixing screw 56 to fix the rear cap 55 to the socket base 54, a guide pin 58 used to guide the stage 51 so that it can come near to or can part from each of the probes 53, and a screw 57 used to fit the guide pin 58 being inserted from a side of a bottom of the socket base 54.

The stage 51 is provided with a tapering hole used to receive the semiconductor device and to perform positioning at a predetermined position. After positioning of the above semiconductor device has been performed along the tapering hole, each of the solder balls mounted in the semiconductor device is placed in an upward position of each of the probes 53. Therefore, when the stage 51, together with the semiconductor device, is pushed by an automatic machine (not shown) through the application of pressure to come near to the socket base 54, each of the solder balls mounted in the semiconductor device comes into contact with an end of the probes 53 extruding at a surface of the socket base 54. Each of the probes 53 has a contactor extruding from both ends of a circularly cylindrical body and each contactor is extendable by a coil spring in the circularly cylindrical body. The contactor being in contact with each of the solder balls is shown in FIG. 5(*a*) and another contactor is shown in FIG. 5(*b*).

In the socket holder 60 described above, as shown in FIG. 6 and FIG. 7, to a socket base 68 is fixed a socket mounting base 61 by substrate fixing screws 62. Printing wiring being in electric contact with each of the probes 53 is carried out on the socket mounting base 61 and the semiconductor socket 50 is fixed to the socket mounting base 61 using a socket fixing screw 63.

Moreover, the socket mounting base 61 is fixed on a pedestal 64 using a pedestal fixing screw 69 and the pedestal 64 is fixed on a DUT (Device Under Test) board 65 on which specified electrical circuits are formed using a board fixing screw 66. Furthermore, in order to electrically connect the socket mounting base 61 and the DUT board 65, an electrically conductive connecting pin 67 is provided between the socket mounting base 61 and the DUT board 65.

When pressure more than necessary is applied to the probes 53 and/or when force acting toward a horizontal direction is applied to the probes 53 due to an operating failure of the automatic machine pushing the stage 51 together with the semiconductor device, buckling and/or breakage occur in the contactor of each of the probes 53. In order to replace the damaged probes 53, following disassembling procedures described below are required.

First, the socket holder 60 is taken off from the automatic machine of the semiconductor test apparatus. Next, a plurality of the pedestal fixing screws 69 is removed through a hole formed in the socket base 68. Then, the socket mounting base 61 is removed from the pedestal 64. At this point, the connecting pin 67 is also removed together with the pedestal 64. Then, a plurality of substrate fixing screws 62 is removed from a bottom of the socket mounting base 61. Next, the socket mounting base 61 is removed from the socket base 68. Then, a plurality of the socket fixing screws 63 is removed from a bottom of the socket mounting base 61 and then the socket mounting base 61 is removed from the semiconductor socket 50. Next, in the semiconductor socket 50 shown in FIG. 4, a plurality of the rear cap fixing screws 56 is taken off from a bottom of the socket base 54 and then the rear cap 55 is taken off. Moreover, in order to prevent the probes 53 from falling off, the probes 53 to be replaced are pulled out by using a pincette and is replaced with a new one. After the replacement of defective probes, each member is combined using a plurality of screws in a retrograde order and the socket holder 60 described above is set to a predetermined position in the automatic machine.

Thus, since removal of the rear cap 55 existing at a bottom of the socket base 54 is necessary for the replacement of the probes 53, the semiconductor socket has to be taken off from the socket holder 60 according to the above procedures and therefore much time and efforts are required for the replacement work of the probes 53.

SUMMARY OF THE INVENTION

In view of the above, it is an object of the present invention to provide a semiconductor socket being capable of saving time and efforts required for replacement of probes and of reducing time required for replacement of the probes. It is another object of the present invention to provide a method for replacing probes in the semiconductor socket.

According to a first aspect of the present invention, there is provided a semiconductor socket including:

a stage used for positioning of a semiconductor device at a bottom of which a plurality of external input/output terminals is mounted;

probes used to come into contact with the plurality of external input/output terminals in the semiconductor device on which positioning has been performed by approaching of the stage;

a socket base in which the probes are housed in a manner so as to be inserted or pulled out on a face being opposite to the stage; and a falling-off preventing unit mounted to a face of the socket base being opposite to the stage in a manner so as to be removable and operated to prevent the probes from falling off.

In the foregoing, a preferable mode is one that wherein includes a guide pin which extrudes from the face of the socket base being opposite to the stage and pierces the stage to guide the stage in a manner that the stage is able to come near to or to part from the probe and an E-ring mounted to an end of the guide pin having pierced the stage in a manner so as to be attachable and detachable.

Also, a preferable mode is one that wherein includes a guide pin being inserted from a bottom of the socket base and being fixed in a manner that it pierces the falling-off preventing unit and can be removable on the stage and to guide the stage in a manner that the stage is able to come near to or part from the probe.

According to a second aspect of the present invention, there is provided a method of replacing a probe in a semiconductor socket being provided with a stage used for positioning of a semiconductor device at a bottom of which a plurality of external input/output terminals is mounted, probes used to come into contact with the plurality of external input/output terminals in the semiconductor device on which positioning has been performed by approaching of the stage, a socket base in which the probes are housed in a manner so as to be inserted or pulled out on a face being opposite to the stage and a falling-off preventing unit mounted to a face of the socket base being opposite to the stage in a manner so as to be removable and operated to prevent the probes from falling off, the method including:

a step of removing the stage from the socket base;

a step of removing the falling-off preventing unit from the socket base; and a step of removing a probe to be replaced from the socket base and of inserting a new probe, instead of the probe to be replaced, into the socket base.

With the above configuration, since the probes can be replaced without taking off the semiconductor socket from the socket holder, time required for replacing the probes can be shortened.

BRIEF DESCRIPTION OF THE DRAWINGS

The above and other objects, advantages and features of the present invention will be more apparent from the following description taken in conjunction with the accompanying drawings in which.

DESCRIPTION OF THE PREFERRED EMBODIMENTS

Best modes of carrying out the present invention will be described in further detail using various embodiments with reference to the accompanying drawings.

First Embodiment

Figure 1:
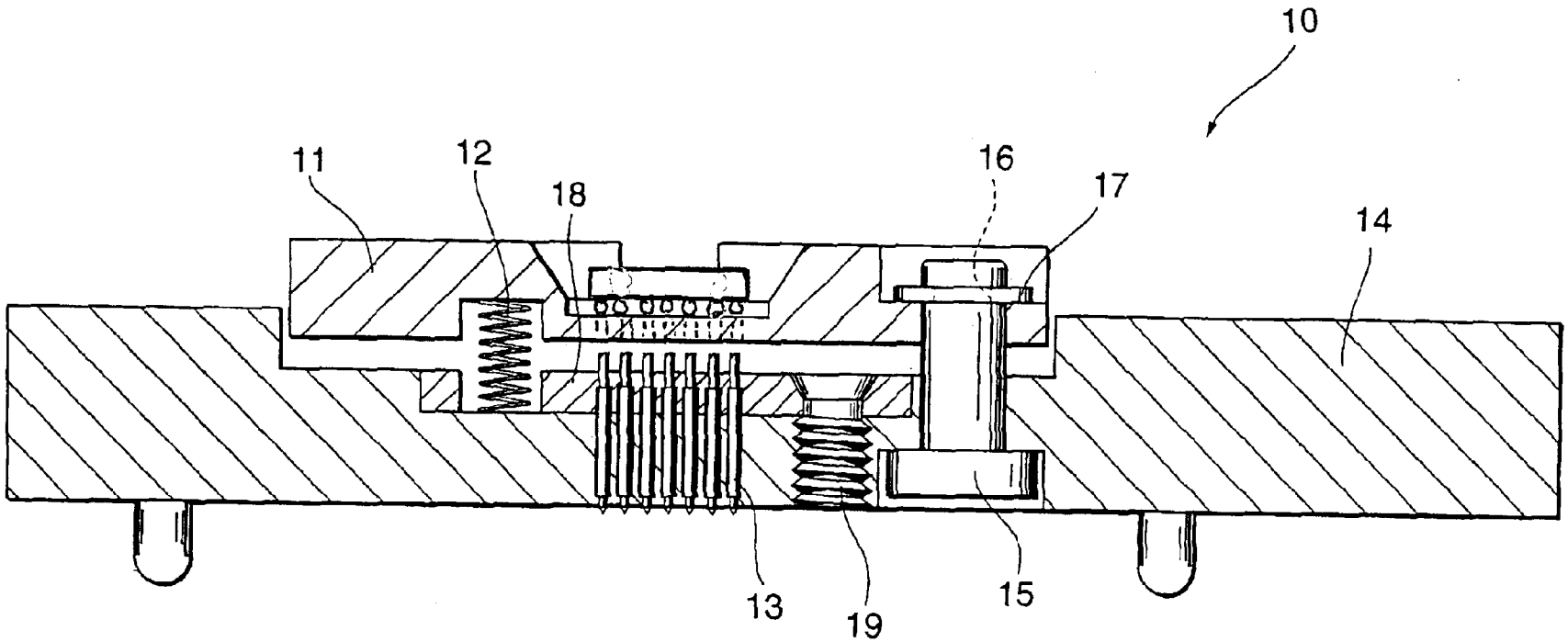
FIG. 1 is a cross-sectional view illustrating a semiconductor socket according to a first embodiment of the present invention.

FIG. 1 is a cross-sectional view illustrating a semiconductor socket 10 according to a first embodiment of the present invention. The semiconductor socket 10 shown in FIG. 1 is provided with a stage 11 to perform positioning, along a tapering hole, on a semiconductor device having a plurality of solder balls serving as an external-input and output terminal at its bottom, each of probes 13 which comes into contact with each of the solder balls in the semiconductor device having undergone positioning by approaching of the stage 11 against elasticity of a spring 12 acting as an elastic body, and a socket base 14 housing the probes 13 in a manner so as to be inserted and pulled out on a side of a face being opposite to the stage 11.

Moreover, the semiconductor socket 10 further has a guide pin 15 adapted to extrude from a face of a socket base 14 being opposite to the stage 11 and to pierce the stage 11 used to guide the stage 11 in such a manner that the stage 11 can come near to and part from the probes 13, a C-ring 17 being mounted so as to be attachable and detachable by a concave groove 16 formed in a predetermined position at an end of the guide pin 15 having pierced the stage 11, a cap 18 serving as a falling-off preventing section to prevent the probes 13 being housed in the socket base 14 from falling off, and a flat-head screw 19 used to fix a cap 18 to the socket base 14 without interfering with the coming stage 11.

Figure 2:
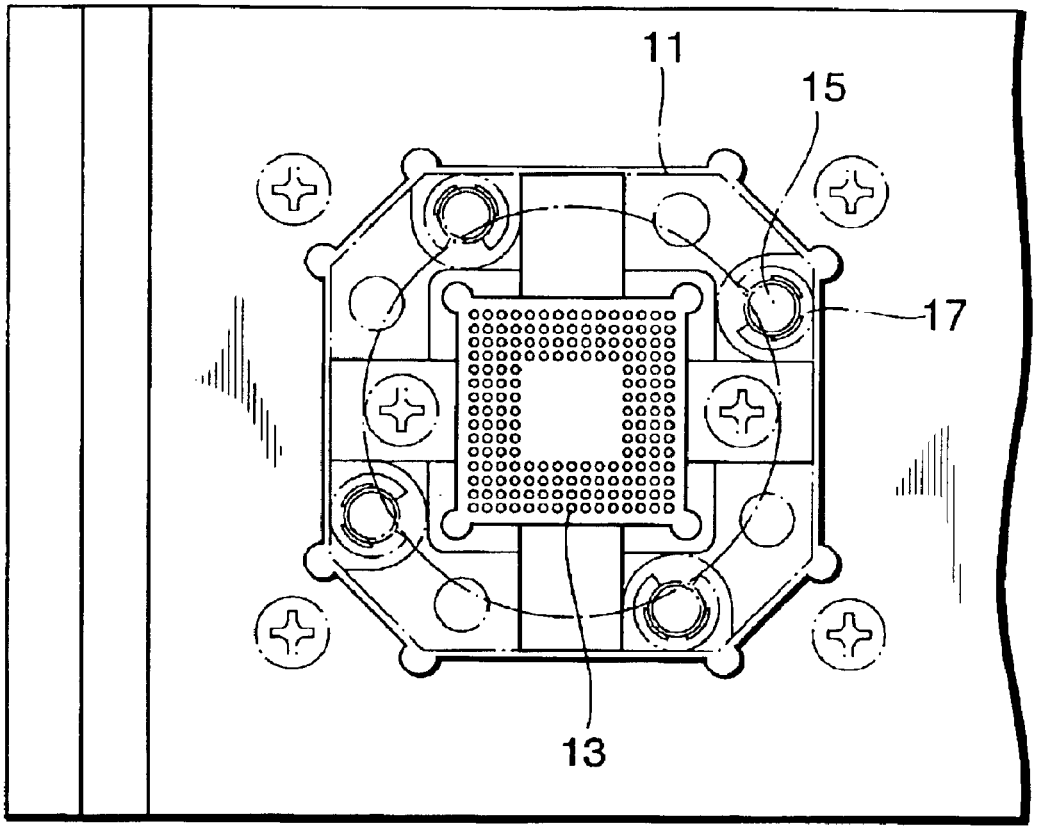
FIG. 2 is a top view illustrating a semiconductor socket according to the first embodiment of the present invention.

The stage 11 in which the semiconductor device is held is guided in an upward and downward direction along the guide pin 15. Moreover, as shown in FIG. 2, on a surface side of the stage 11 is formed a concave portion being opened at an end of the stage 11 in which an end of the guide pin 15 is positioned. Furthermore, the stage 11 keeps a constant interval at all times relative to the socket base 14 by the spring 12 being mounted between the stage 11 and the socket base 14 unless pushing pressure is exerted to the stage 11 from an outside.

Figure 6:
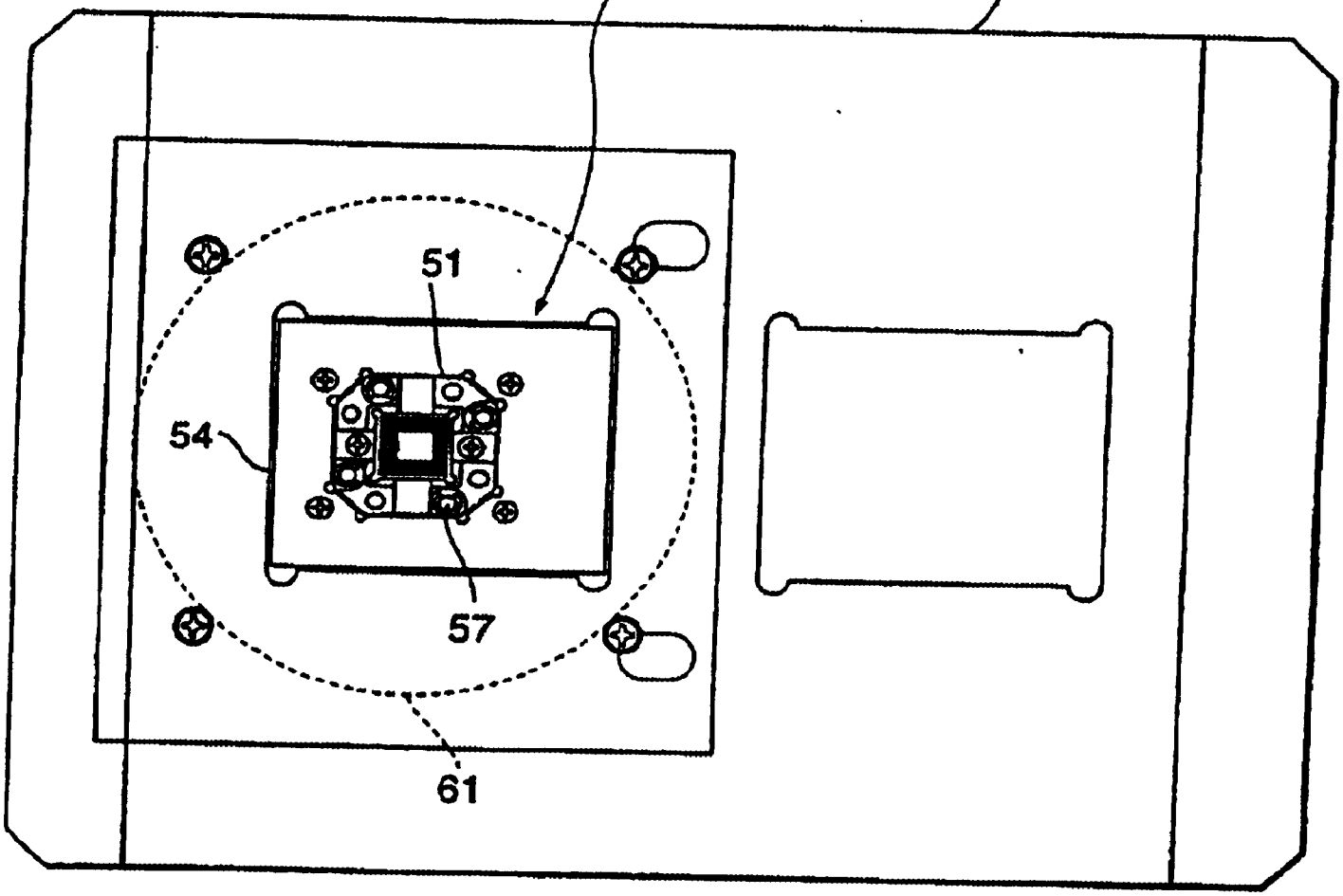
Fig.6 Prior Art
FIG. 6 is a top view illustrating a socket holder.
Figure 7:
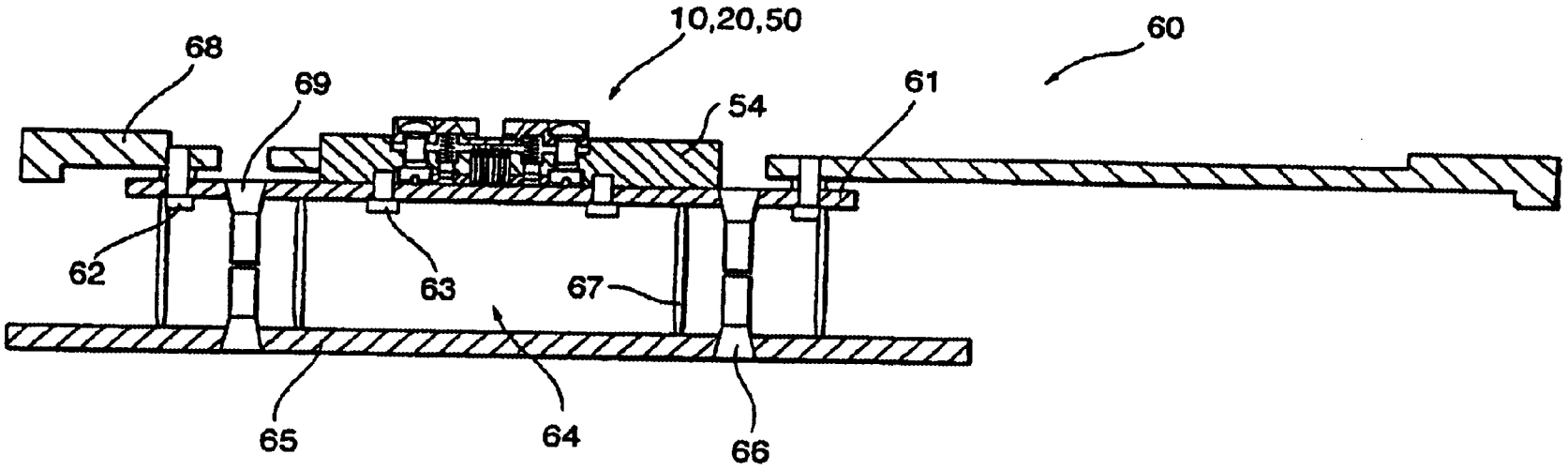
Fig.7 Prior Art
FIG. 7 is a cross-sectional view illustrating a socket holder.

The semiconductor socket 10 of the first embodiment of the present invention, as shown in FIG. 6 and FIG. 7 and as in the case of the conventional semiconductor socket 50, is placed and fixed in a predetermined position on the socket mounting base 61 constituting the socket holder 60. The socket holder 60 in which the semiconductor socket 10 of the first embodiment of the present invention is embedded is set to an automatic machine of the semiconductor test apparatus as in the conventional case described above.

Next, a method of replacing a damaged probe 13 of the semiconductor socket 10 of first embodiment of the present invention to be employed when damage occurs on the semiconductor socket 10 is explained. First, a socket holder 60 is taken off from an automatic machine of the semiconductor test apparatus. Next, the E-ring 17 in the concave portion formed in the stage 11 without removing the semiconductor socket 10 of the first embodiment of the present invention from the socket holder 60 and then the stage 11 is taken off. At this time, the spring 12 is also taken off. Next, the flat-head screw 19 is taken off and then the cap is also taken off. Then, the probes 13 to be replaced using a pincette or a like is taken off from the socket base 14 and a new probe 13 is inserted. After the replacement of the probes 13, the semiconductor socket 10 of the first embodiment of the present invention is assembled in a retrograde order and then the socket holder 60 is set in a predetermined position.

Thus, according to the first embodiment of the present invention, as described above, since the probes 13 can be replaced without taking off the semiconductor socket 10 from the socket holder 60, time and efforts required for disassembling and assembling the socket holder 60 obtained by combining a plurality of components using screws can be saved and time required for replacing the probes 13 can be shortened.

Moreover, according to the first embodiment of the present invention, as described above, since disassembling and assembling of the socket holder 60 is not required, electrical contact failures between the connecting pin 67 and socket mounting base 61, between the connecting pin 67 and DUT board 65, and between the probe 13 and socket mounting base 61, that may occur due to the assembling process following the disassembling, can be reduced.

Furthermore, by applying the semiconductor socket 10 of the present invention to the semiconductor test apparatus, when a failure occurs in the probe 13, since the detective probe 13 can be replaced within a short time, an operation rate of the semiconductor test apparatus can be improved.

Second Embodiment

In the semiconductor socket 10 of the first embodiment of the present invention, the cap 18 is fixed by using the flat-head screw. However, in a semiconductor socket 20 of the second embodiment of the present invention, a cap 18 can be fixed without using a flat-head screw 19, which is shown in the cross-sectional view in FIG. 3.

Figure 3:
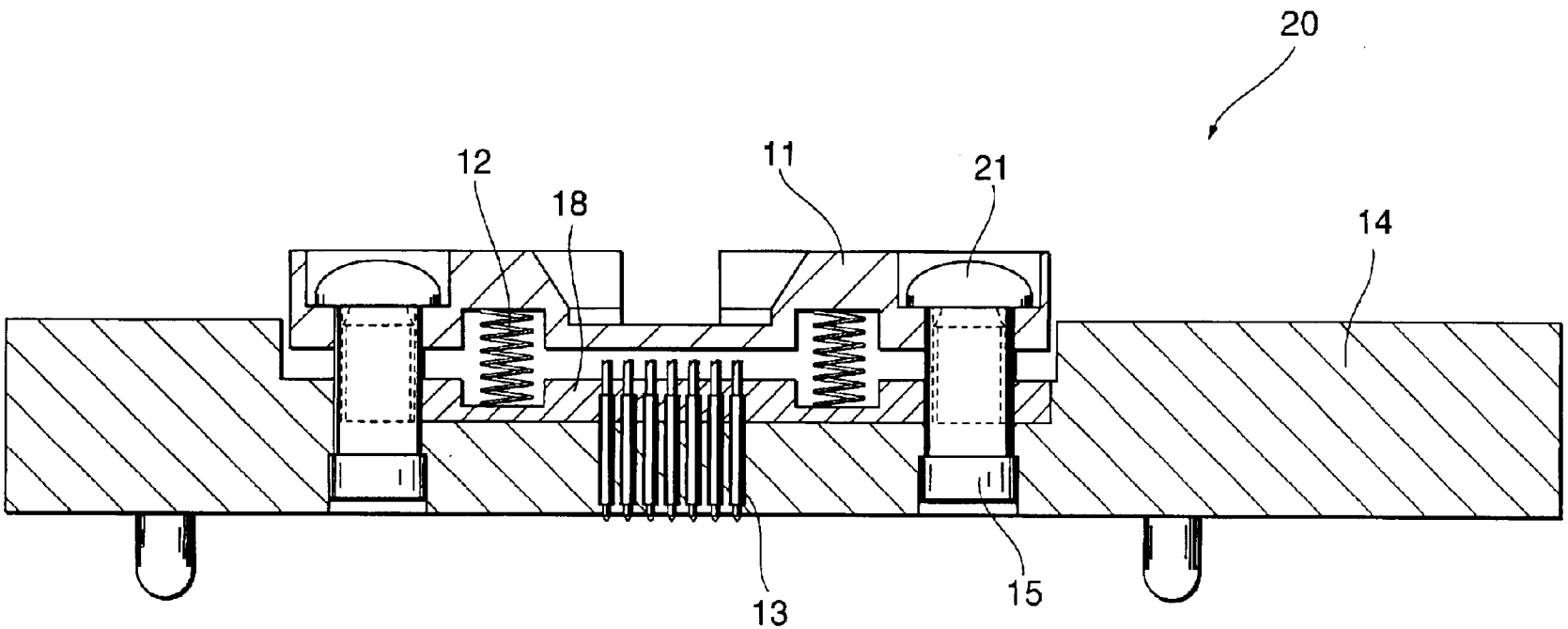
FIG. 3 is a cross-sectional view illustrating a semiconductor socket according to a second embodiment of the present invention.
Figure 4:
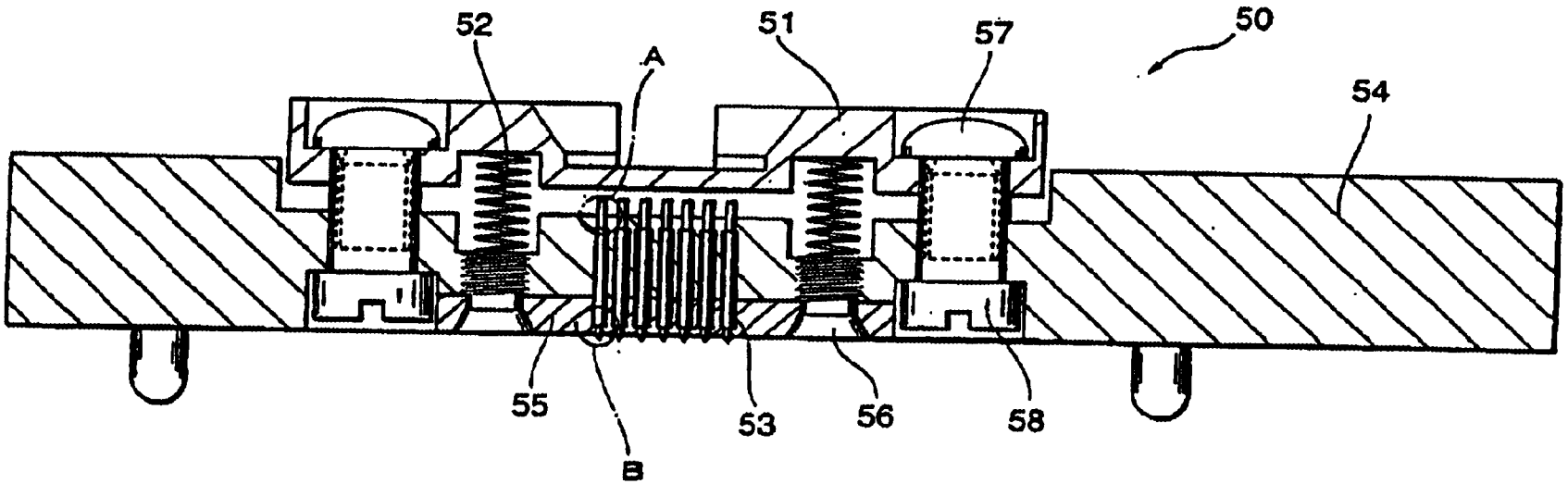
Fig.4 Prior Art
FIG. 4 is a cross-sectional view illustrating a conventional semiconductor socket.
Figure 5A:
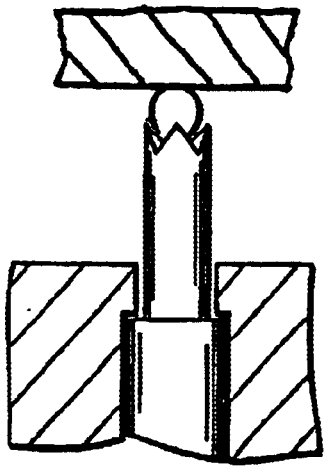
Fig.5(a) Prior Art
FIG. 5(*a*) is a cross-sectional view illustrating a contactor being mounted on a top of each of probes being in contact with a solder ball and FIG. 5(*b*) is a cross-sectional view illustrating another end of the probes.
Figure 5B:
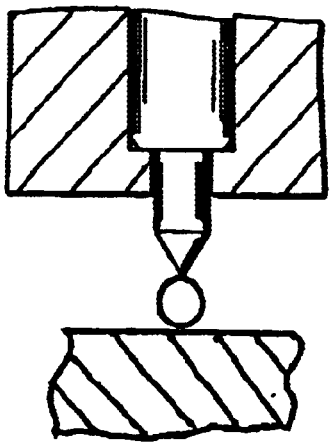
Fig.5(b) Prior Art

The semiconductor socket 20 shown in FIG. 3 is provided with a stage 11 to perform positioning, along a tapering hole, on a semiconductor device having a plurality of solder balls at its bottom, each of probes 13 which comes into contact with each of the solder balls in the semiconductor device having undergone positioning by approaching of the stage 11 against elasticity of a spring 12 acting as an elastic body, and a socket base 14 housing the probe 13 in a manner so as to be inserted and pulled out on a side of a face being opposite to the stage 11.

Moreover, the semiconductor socket 20 further has a guide pin 15 adapted to be inserted from a bottom of the socket base 14 and to come through the cap 18 serving as a falling-off preventing section to prevent the probe 13 from falling off and then to be inserted into the socket base 14 and to be pierced on a surface of the socket base 14 and to guide the stage 11 so that it can come near to and part from each of the probes 13, and a screw 21 used to fix the guide pin 15 by connecting an internal wall of the guide pin 15 being extruded on a surface of the socket base 14 using a screw.

In the second embodiment of the present invention, a spring 12 is provided between the stage 11 and cap 18 and the guide pin 15 being inserted from a side of a bottom of the socket base 14 is fixed by the screw 21 on a side of the stage 11 against elasticity possessed by the spring 12 mounted between the stage 11 and the cap 18. Since the elasticity of the spring 12 is applied to the cap 18, a fixing tool used to fix the cap 18 to the socket base 14 is not required.

The semiconductor socket 20 of the second embodiment of the present invention, as in the case of the conventional semiconductor socket as shown in FIG. 6 and FIG. 7, is mounted and fixed in a predetermined position on a socket mounting base 61 constituting the socket holder 60. The socket holder 60 embedded in the semiconductor socket 20 of the second embodiment of the present invention is set to an automatic machine in the semiconductor test apparatus as in the conventional case.

Next, a method of replacing a damaged probe 13 to be applied when damage occurs in the probe 13 in the semiconductor socket 20 of the second embodiment of the present invention is explained. First, the socket holder 60 is taken off from the automatic machine in the semiconductor test apparatus. Next, connection by screws between the guide pin 15 and the screw 21 is released without taking off the semiconductor socket 20 from the socket holder 60 and the screw 21 is removed. Then, the stage 11 is removed. At this point, the spring 12 is also taken off at the same time. Then, the cap 18 is removed. Next, by using a pincette or a like, the probe 13 to be replaced is taken off from the socket base 14 and a new probe 13 is inserted. After the replacement of a defective probe, each member is combined using a plurality of screws in a retrograde order and the socket holder 60 described above is set to a predetermined position in the automatic machine.

Thus, according to the second embodiment of the present invention, as described above, it is not necessary to take the semiconductor socket 20 off from the socket holder 60. Moreover, the cap 18 can be removed when the screw 21 is taken off, resulting in replacement of the probe 13 and, therefore, effects that time required for replacing the probe 13 can be obtained in addition to effects achieved by the first embodiment of the present invention described above.

It is apparent that the present invention is not limited to the above embodiments but may be changed and modified without departing from the scope and spirit of the invention.

What is claimed is:

1. A semiconductor socket, comprising:

a stage used for positioning of a semiconductor device, the semiconductor device having a plurality of external input/output terminals mounted at a bottom thereof:

a plurality of probes used to come into contact with the plurality of external input/output terminals when the semiconductor device has been positioned, by moving said stage towards said probes;

a socket base in which a major portion of each of said probes is housed, and from which a minor portion of each of said probes projects from an upper face thereof, the upper face of said socket base facing said stage, said probes being disposed in a manner so as to be inserted in or pulled out from the upper; and a probe retaining cap removably mounted to the upper a face of said socket base, for preventing said probes from being removed.

2. The semiconductor socket according to claim 1 further comprising:

a guide pin which projects from the upper face of said socket base and pierces said stage, and serves to guide said stage in a manner that said stage is able to come near to or to part from said probes; and a C-ring mounted to an end of said guide pin that has pierced said stage, in a manner so as to be attachable and detachable.

3. A semiconductor socket, comprising:

a stage used for positioning of a semiconductor device, the semiconductor device having a plurality of external input/output terminals mounted at a bottom thereof;

a plurality of probes used to come into contact with the plurality of external input/output terminals when the semiconductor device has been positioned, by moving said stage towards said probes;

a socket base in which said probes are housed, an upper face of said socket base facing said stage, said probes being disposed in a manner so as to be inserted in or pulled out from the upper face;

a probe retaining cap removably mounted to the upper face of said socket base, for preventing said probes from being removed; and a guide pin inserted from a bottom of said socket base and being fixed in a manner that it pierces said probe retaining cap and is removable from said stage and serves to guide said stage in a manner that said stage is able to come near to or part from said probes.

4. A method of replacing a probe in a semiconductor socket, comprising:

providing a semiconductor socket having a stage used for positioning of a semiconductor device, the semiconductor device having a plurality of external input/output terminals mounted at a bottom thereof, the semiconductor socket further having a plurality of probes used to come into contact with the plurality of external input/output terminals when the semiconductor device has been positioned, by moving said stage towards said probes, the semiconductor socket also having a socket base in which a major portion of each of said probes is housed, and from which a minor portion of each of said probes projects from an upper face thereof, the upper face of the socket base facing the stage, the probes being disposed in a manner so as to be inserted in or pulled out from the upper a face; the semiconductor socket also having a probe retaining cap removably mounted to the upper a face of said socket base, for preventing said probes from being removed;

removing said stage from said socket base;

removing said probe retaining cap from said socket base;

removing a probe to be replaced from said socket base; and inserting a new probe in a space in said socket base, which was previously occupied by the, probe to be replaced.

* * * * *